US012729878B2

(12) United States Patent
Wada et al.

(10) Patent No.: US 12,729,878 B2
(45) Date of Patent: Sep. 8, 2026

(54) HEAT EXCHANGER AND HOT WATER APPARATUS INCLUDING HEAT EXCHANGER

(71) Applicant: NORITZ CORPORATION, Hyogo (JP)

(72) Inventors: Norihide Wada, Hyogo (JP); Kengo Horiuchi, Hyogo (JP); Hideyuki Fujisawa, Hyogo (JP); Akinobu Nakamura, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 382 days.

(21) Appl. No.: 18/502,066

(22) Filed: Nov. 5, 2023

(65) Prior Publication Data

US 2024/0167725 A1 May 23, 2024

(30) Foreign Application Priority Data

Nov. 17, 2022 (JP) ..... 2022-183861

(51) Int. Cl.

| | |
|---|---|
| ***F24H 1/16*** | (2022.01) |
| ***F24H 9/14*** | (2006.01) |
| ***F28F 9/18*** | (2006.01) |

(52) U.S. Cl.

CPC ..... *F24H 1/16* (2013.01); *F24H 9/146* (2013.01); *F28F 9/182* (2013.01); *F28F 2275/04* (2013.01)

(58) Field of Classification Search

CPC .. F28F 9/26; F28F 2275/04; F28F 9/02; F28F 9/0219; F28F 9/0231; F28F 9/0248; F28F 9/0256; F24H 1/16; F24H 9/0005

See application file for complete search history.

(56) References Cited

U.S. PATENT DOCUMENTS

| | | | | |
|---|---|---|---|---|
| 4,150,720 | A * | 4/1979 | Brackman | F24S 10/502 165/170 |
| 5,251,692 | A * | 10/1993 | Haussmann | F28D 1/05383 165/177 |
| 9,970,716 | B2 * | 5/2018 | Iguchi | F28F 9/02 |
| 10,267,575 | B2 * | 4/2019 | Yamaji | F28F 9/02 |
| 10,465,944 | B2 * | 11/2019 | Okuda | F24H 9/0015 |

FOREIGN PATENT DOCUMENTS

| | | | | |
|---|---|---|---|---|
| DE | 4009780 | A1 * | 10/1991 | F28F 9/182 |
| EP | 0164327 | A1 * | 12/1985 | F24S 80/30 |
| FR | 2726076 | A1 * | 4/1996 | F28F 9/0224 |

(Continued)

*Primary Examiner* — Gregory A Wilson

(74) *Attorney, Agent, or Firm* — JCIPRNET

(57) ABSTRACT

A heat exchanger includes a header part that is arranged on an outer surface side of a sidewall part of a case into which a combustion gas is supplied, and has hole parts through which end parts of heat transfer tubes are inserted and forms a chamber communicating between insides of the heat transfer tubes. The heat exchanger further includes a burring part in a tubular shape that protrudes from a circumferential edge part of each hole part of the header part toward the sidewall part side and is externally fitted to the end part of each heat transfer tube, and an extension part that partially extends from a part of a tip circumferential edge part of the burring part toward the sidewall part side and has a tip part abutting against the sidewall part.

8 Claims, 6 Drawing Sheets

(56) References Cited

FOREIGN PATENT DOCUMENTS

| | | | | | |
|---|---|---|---|---|---|
| JP | 2020051683 | A | * | 4/2020 | ..... B21D 39/20 |
| JP | 2021032494 | | | 3/2021 | |
| JP | 6895048 | | | 6/2021 | |
| KR | 200201563 | Y1 | * | 11/2000 | ..... F28F 9/002 |
| KR | 20080040528 | A | * | 5/2008 | ..... F28F 9/182 |
| WO | WO-8501680 | A1 | * | 4/1985 | ..... F16B 11/008 |
| WO | WO-2011087326 | A2 | * | 7/2011 | ..... F16L 13/0209 |

* cited by examiner

HEAT EXCHANGER AND HOT WATER APPARATUS INCLUDING HEAT EXCHANGER

CROSS-REFERENCE TO RELATED APPLICATION

This application claims the priority benefit of Japan application serial no. 2022-183861, filed on Nov. 17, 2022. The entirety of the above-mentioned patent application is hereby incorporated by reference herein and made a part of this specification.

BACKGROUND

Technical Field

The disclosure relates to a heat exchanger used as a component of, for example, a hot water supply apparatus, and a hot water apparatus such as a hot water supply apparatus including the heat exchanger.

Related Art

Heat exchangers have been described in, for example, Patent Document 1 (Japanese Patent Application Laid-Open No. 2021-32494) and Patent Document 2 (Japanese Patent No. 6895048). The heat exchangers described in these documents are assembled to hot water supply apparatuses or the like and used for heating hot/cold water, and in the heat exchanger, a plurality of heat transfer tubes are accommodated in a case into which a heating medium such as a combustion gas is supplied. End parts of the plurality of heat transfer tubes are drawn out to outside through hole parts provided at a sidewall part of the case, and header parts are attached to these portions. A chamber that allows communication between insides of the plurality of heat transfer tubes is formed in the header part, and the insides of the plurality of heat transfer tubes communicate with each other via the chamber. Thus, using the header part, it is possible to properly execute predetermined hot/cold water circulation in the plurality of heat transfer tubes.

However, in the related art described above, there is room for improvement as described below.

That is, in the case of attaching a header part to the end parts of the heat transfer tubes, it is desirable to prevent, as much as possible, the header part from abutting against the sidewall part of the case by a large area. If the header part abuts against the sidewall part of the case by a large area, once the temperature of the sidewall part of the case rises due to the supply of the heating medium such as the combustion gas into the case, the temperature of the header part also rises similarly and a large thermal stress occurs, which acts on the heat transfer tubes and becomes one of the factors that cause distortion in the heat transfer tubes. As a means for solving such an issue, in Patent Document 1, the header part is provided at a position separated from the sidewall part of the case. However, according to such a means, positioning of the header part becomes difficult, and there is room for improvement from the viewpoint of facilitating manufacturing. On the other hand, in Patent Document 2, since a plate material serving as a spacer is interposed between the sidewall part of the case and the header part, it is possible to ensure the positioning of the header part. However, according to such a means, since the plate material is used as a spacer, the total number of components increases, which is likely to lead to complication of the manufacturing work and an increase in manufacturing costs. Thus, there is room for improvement in that case as well.

SUMMARY

Embodiments of the disclosure adopt the following technical means.

A heat exchanger provided according to a first aspect of the disclosure includes a case, a plurality of heat transfer tubes, and a header part. A combustion gas is supplied into the case. The plurality of heat transfer tubes are accommodated in the case and have end parts drawn out to outside of the case via a plurality of hole parts provided at a sidewall part of the case. The header part is arranged on an outer surface side of the sidewall part, and has a plurality of hole parts through which the end parts of the plurality of heat transfer tubes are inserted and forms a chamber communicated to insides of the plurality of heat transfer tubes. The heat exchanger further includes a plurality of burring parts and an extension part. The plurality of burring parts in a tubular shape are provided to protrude from circumferential edge parts of the plurality of hole parts of the header part toward a sidewall part side of the case, and are externally fitted to the end parts of the respective heat transfer tubes. The extension part is provided to partially extend from a part of a tip circumferential edge part of each of the burring parts toward the sidewall part side of the case, and has a tip part abutting against the sidewall part.

With such a configuration, the following effects can be obtained. First, since the tip part of the extension part provided at each burring part of the header part abuts against the outer surface of the sidewall part of the case, it is possible to accurately perform the positioning operation of the header part, i.e., the operation of defining a separation distance from the sidewall part of the case to the header part as a desired dimension and attaching the header part to the heat transfer tube. The positioning of the header part is performed by simply causing the tip part of the extension part to abut against the sidewall part of the case during the assembly operation of the heat exchanger. It is also not required to separately use a dedicated member (spacer) for defining the separation distance. Thus, it is possible to facilitate the attachment operation of the header part, and thus to facilitate the manufacturing work of the entire heat exchanger, improve productivity of the heat exchanger, and suitably reduce the manufacturing costs. Since the tubular burring part of the header part is externally fitted to the end part of the heat transfer tube, an effect of stabilizing the fitting connection states thereof can also be obtained. Second, although the tip part of the extension part abuts against the sidewall part of the case, it is possible to make the abutment area small. Thus, for example, different from the case where the header part abuts against the sidewall part of the case by a large area, herein, in the case where the temperature of the sidewall part of the case rises due to supply of the combustion gas into the case, it becomes possible to eliminate a phenomenon that the temperature of the header part similarly rises and a large thermal stress occurs and acts on the heat transfer tube. Thus, it is also possible to appropriately suppress distortion occurring at the heat transfer tube due to the thermal stress of the header part.

In an embodiment of the disclosure, the extension part may be configured to have a width of the tip part that is smaller than a width of a base part.

With such a configuration, the abutment area between the tip part of the extension part and the sidewall part of the case is made smaller, which may further suppress the phenomenon in which the thermal stress of the header part affects the heat transfer tube.

In an embodiment of the disclosure, the heat exchanger may further include a brazing part at which a brazing material enters between the end part of each of the heat transfer tubes and the burring part from an outer portion of the burring part on a tip circumferential edge part side.

With such a configuration, it is possible to appropriately join between the burring part of the header part and the heat transfer tube using the brazing part. If the length of the burring part is increased, it is also easy to increase the volume of the brazing part and increase the brazing strength.

In an embodiment of the disclosure, in a predetermined brazing-applicable posture in which the end part of each of the heat transfer tubes extends in a horizontal direction and the case stands upright in an up-down height direction, the extension part may be located at a position avoiding a topmost part of the burring part.

With such a configuration, it is possible to easily and appropriately perform the brazing operation for providing the brazing part. That is, in the manufacturing process of the heat exchanger, the method of setting the case to the predetermined brazing-applicable posture and brazing the end part of the heat transfer tube and the burring part of the header part includes applying a brazing material to a position of the topmost part of the end part of the heat transfer tube in the vicinity of the topmost part of the tip circumferential edge part of the burring part, and then heating and melting the brazing material. According to this configuration, since it is possible to configure such that the extension part of the header part is not present at the position at which the brazing material is applied, it is possible to appropriately perform the brazing operation without hindrance.

In an embodiment of the disclosure, a plurality of extension parts may be included as the extension part provided at each of the burring parts, and an inner width between tip parts of the plurality of extension parts may be larger than an inner diameter of each of the burring parts.

With such a configuration, in the manufacturing process of the heat exchanger, in the case where a plurality of extension parts and the burring part are externally fitted to the end part of the heat transfer tube, since it is possible to increase a gap between the heat transfer tube and the plurality of extension parts, it is possible to configure such that the plurality of extension parts do not hinder the external fitting operation. On the other hand, since it is possible to reduce the gap between the heat transfer tube and the burring part, stabilization of the fitting states thereof is appropriately achieved.

In an embodiment of the disclosure, the plurality of extension parts may have a tip-spread slope shape in which an inner width of the plurality of extension parts gradually increases toward tip part sides of the plurality of extension parts.

With such a configuration, in the manufacturing process of the heat exchanger, in the case of performing the operation of externally fitting the plurality of extension parts and the burring part of the header part to the end part of the heat transfer tube, it becomes easier to smoothly externally fit the plurality of extension parts to the end part of the heat transfer tube, and it is possible to further facilitate and expedite the operation.

In an embodiment of the disclosure, in the header part, a boundary part between each of the burring parts and the extension part may be provided with a fragile part having a strength partially reduced compared to a surrounding part of the boundary part.

With such a configuration, the following effects can be obtained. That is, in the case of bending and deforming the extension part to be inclined in an outwardly opened shape for reasons such as improving workability when attaching the header part to the end part of the heat transfer tube, it is possible to set the position of the fragile part as the starting point of the bending deformation. By doing so, it is possible to prevent the influence of bending deformation of the extension part from reaching the burring part and avoid undue distortion at the burring part.

A hot water apparatus provided according to a second aspect of the disclosure includes the heat exchanger provided according to the first aspect of the disclosure, and a burner that supplies the combustion gas into the case of the heat exchanger.

With such a configuration, the same effects as described for the heat exchanger provided according to the first aspect of the disclosure can be obtained.

Other features and advantages of the disclosure will become more apparent from the description of embodiments of the disclosure to be provided below with reference to the accompanying drawings.

DESCRIPTION OF EMBODIMENTS

Embodiments of the disclosure provide a heat exchanger and a hot water apparatus including the heat exchanger capable of properly preventing a heat transfer tube from being applied with an undue thermal stress from a header part when the temperature of a sidewall part of a case rises, while suppressing, as much as possible, complication of the manufacturing work and an increase in manufacturing costs.

Hereinafter, exemplary embodiments of the disclosure will be specifically described with reference to the drawings.

A heat exchanger HE shown in FIG. 1 to FIG. 4 includes a case 1 in a substantially rectangular tubular or frame shape with an upper surface part and a lower surface part being opened, a plurality of body pipes 39 arranged in the case 1, and a plurality of heat transfer tubes 2.

Figure 3:
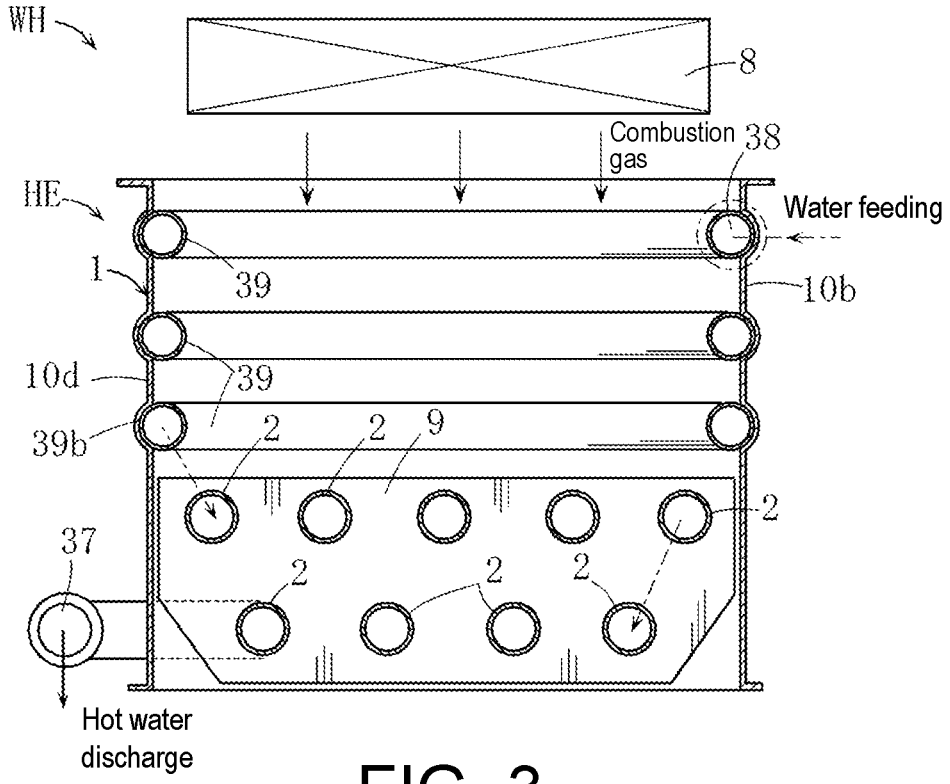
FIG. 3 is a cross-sectional view taken along line III-III in FIG. 1.
Figure 4:
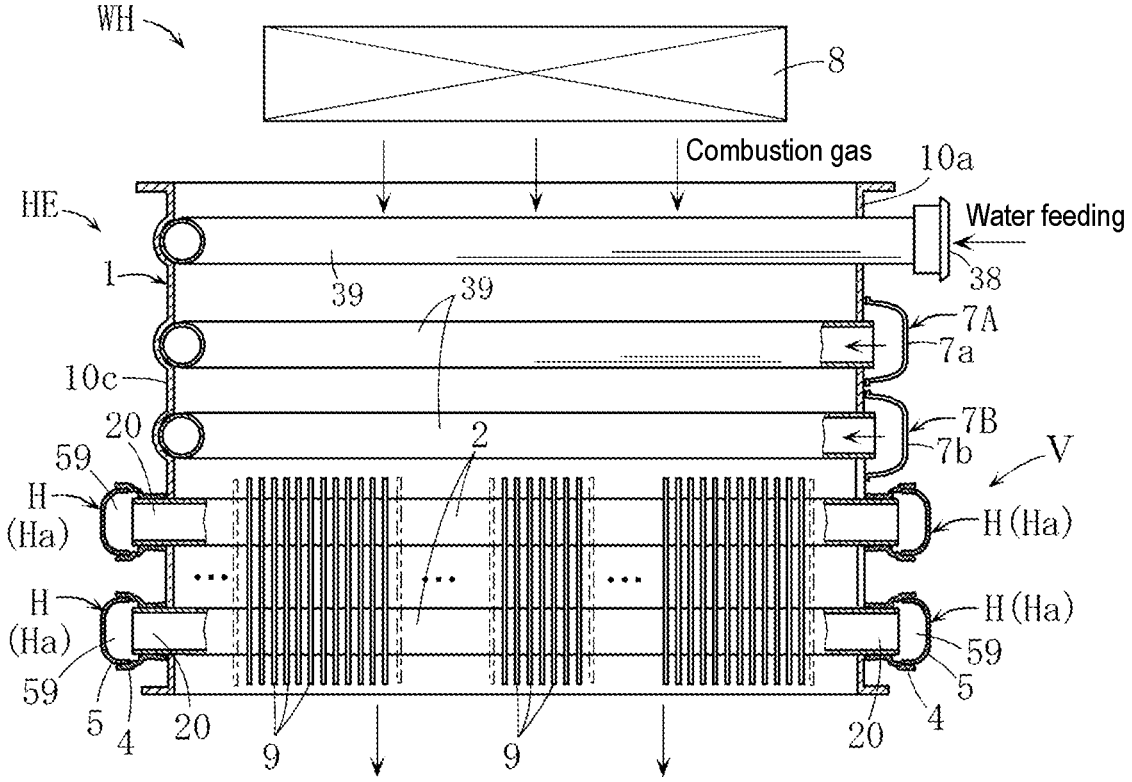
FIG. 4 is a cross-sectional view taken along line IV-IV in FIG. 2.

As shown in FIG. 3 and FIG. 4, the heat exchanger HE of this embodiment is combined with, for example, a burner 8, and is used to configure a hot water apparatus WH such as a hot water supply apparatus. In the burner 8, fuel gas or liquid fuel is burned, and the combustion gas is supplied into the case 1 of the heat exchanger HE. Accordingly, hot/cold water flowing inside the plurality of body pipes 39 and heat transfer tubes 2 is heated, and hot water is generated.

A configuration of the heat exchanger HE will be more specifically described below. The plurality of body pipes 39 of the heat exchanger HE are provided along inner surfaces of a plurality of sidewall parts 10*b* to 10*d* of the case 1, and in addition to absorbing heat from the combustion gas for heating hot/cold water, the plurality of body pipes 39 also serve to cool the plurality of sidewall parts 10*b* to 10*d* and prevent them from becoming overheated. The plurality of body pipes 39 are connected via header parts 7A and 7B provided at an outer surface part of the sidewall part 10*a* of the case 1. The hot/cold water supplied to a water inlet 38 of the body pipe 39 passes through the body pipe 39 and the plurality of header parts 7A and 7B as indicated by broken-line arrows in FIG. 1. Thereafter, the hot/cold water reaches a hot water outlet 37 after flowing through the plurality of heat transfer tubes 2 and header parts H to be described later.

As shown in FIG. 4, at the header parts 7A and 7B, by joining cover members 7*a* and 7*b* with an inner portion being concave to the sidewall part 10*a* of the case 1, a chamber for hot/cold water circulation is formed between the cover members 7*a* and 7*b* and the sidewall part 10*a*. The header parts 7A and 7B do not correspond to a header part in the disclosure (described in the claims). A plurality of header parts H (Ha and Hb) correspond to the header part in the disclosure. However, details will be described later.

Figure 1:
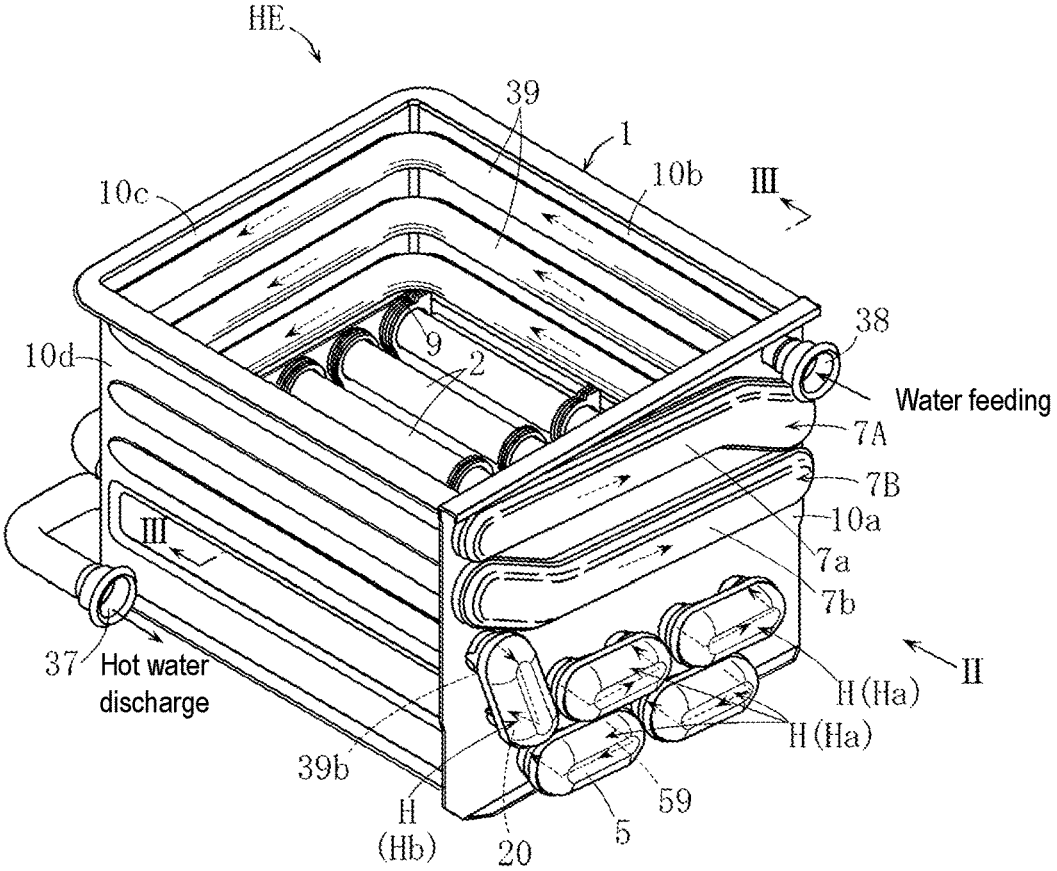
FIG. 1 is a perspective view showing an example of a heat exchanger according to the disclosure.
Figure 2:
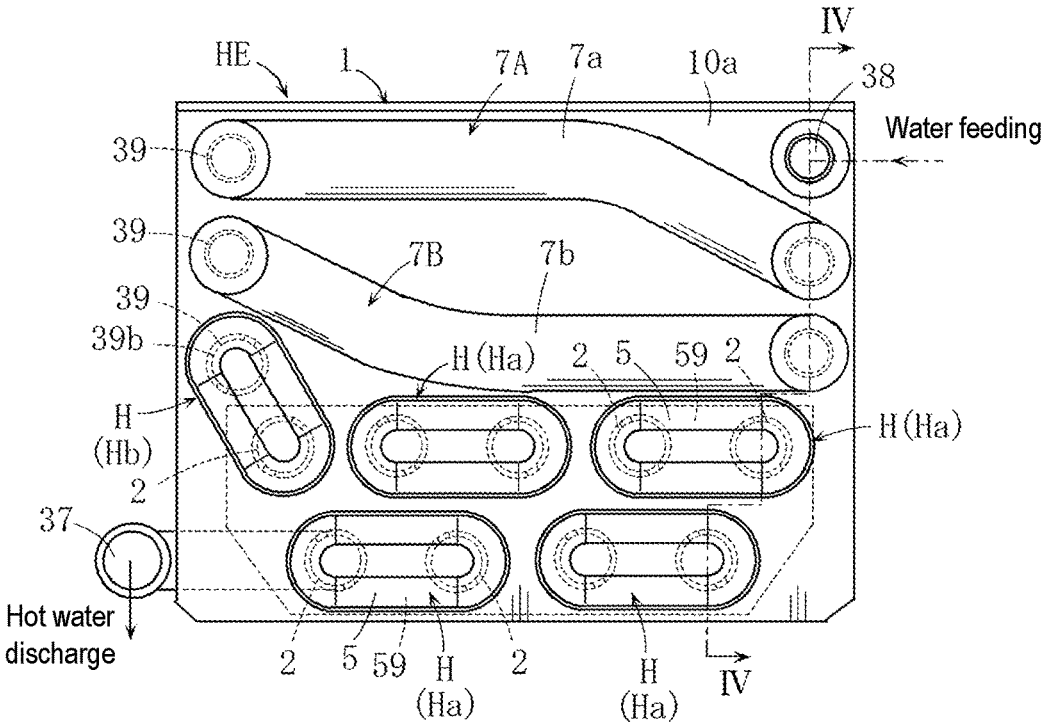
FIG. 2 is a front view viewed from arrow II in FIG. 1.

As shown in FIG. 2 and FIG. 3, the plurality of heat transfer tubes 2 are, for example, of a fin tube type that is inserted and joined to a plurality of fins 9 in a plate shape, and are provided across in the case 1 and arranged side by side in an up-down direction and a horizontal direction. Both end parts 20 of each heat transfer tube 2 penetrate the sidewall parts 10*a* and 10*c* of the case 1 and are drawn out to outside of the case 1.

The heat exchanger HE further includes a plurality of header parts H (Ha and Hb), which have significant features in their configuration. Among the plurality of header parts H, one header part H (Hb) connects an end part 39*b* of a lowermost body pipe 39 with an end part 20 of the heat transfer tube 2. On the other hand, the other header parts H (Ha) connect between the end parts 20 of the plurality of heat transfer tubes 2. Similar to the plurality of heat transfer tubes 2, the lowermost body pipe 39 is included in the heat transfer tube in the disclosure (hereinafter, unless specifically distinguished, the lowermost body pipe 39 and its end part 39*b* will be described as similar parts to the heat transfer tube 2 and its end part 20).

As well depicted in FIG. 5 to FIG. 8B, each header part H is composed by combining a header base 4 and a header cover 5, both being made of metal and having a substantially oblong shape in a front view. The header cover 5 is a member in a cup shape of which one surface side opposed to the sidewall part 10*a* of the case 1 is recessed into a concave shape. The header base 4 includes an outer circumferential wall part 40 to which a tip circumferential wall part of the header cover 5 fits, a main wall part 41 that is connected with the outer circumferential wall part 40 at its outer circumferential edge and is opposed to the sidewall part 10*a* of the case 1, and a pair of hole parts 42 that are provided at the main wall part 41 and through which the end parts 20 of a pair of heat transfer tubes 2 are inserted. A chamber 59 is provided on an inner side of both the header base 4 and the header cover 5 to communicate to the insides of the end parts 20 of the pair of heat transfer tubes 2 and allows hot/cold water to flow from one to the other of the pair of heat transfer tubes 2.

The header base 4 further includes a burring part 43, an extension part 44, and a fragile part 45.

The burring part 43 is a member of the main wall part 41 in a cylindrical shape that protrudes from a circumferential edge part of each hole part 42 toward the sidewall part 10*a* side of the case 1 and is integrally formed with the main wall part 41. The burring part 43 is externally fitted to the end part 20 of the heat transfer tube 2 and is brazed to the end part 20 via a brazing part Br (in FIG. 5 and FIG. 6A, the brazing part Br is shown as a blackened portion, but in FIG. 6B, only a portion of the brazing part Br is schematically shown in virtual lines). The brazing part Br is configured such that a brazing material enters from an outer portion on a tip circumferential edge part 43*a* side of the burring part 43 into a region between an outer circumferential surface of the end part 20 of the heat transfer tube 2 and an inner circumferential surface of the burring part 43.

The extension part 44 is a part that partially extends from a part of the tip circumferential edge part 43*a* of the burring part 43 toward the sidewall part 10*a* side of the case 1 and abuts against the sidewall part 10*a*, and is integrally formed with the burring part 43. In this embodiment, two extension parts 44 are provided at one burring part 43.

Figure 8A:
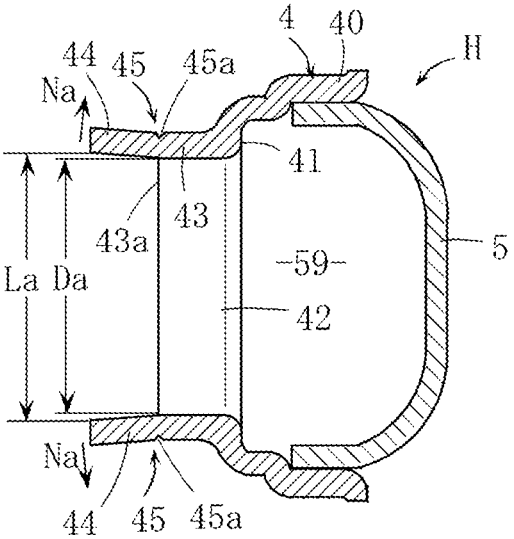
FIG. 8A is a cross-sectional view taken along line VIII-VIII in FIG. 7A.
Figure 8B:
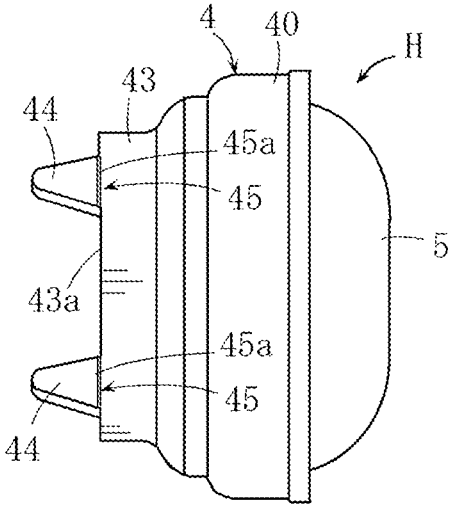
FIG. 8B is a side view of FIG. 7A.

As well depicted in FIG. 8B, each extension part 44 has a substantially triangular shape in a side view, with a tip part having a width smaller than a base part. Further, as well depicted in FIG. 8A, the two extension parts 44 have a tip-spread slope shape in which an inner width between the two extension parts 44 gradually increases toward their tip part side, and an inner width La between the tip parts of the two extension parts 44 is larger than an inner diameter Da of the burring part 43. The inner diameter Da of the burring part 43 is a dimension corresponding to an outer diameter of the end part 20 of the heat transfer tube 2.

The fragile part 45 is a part that is provided at a boundary part between the burring part 43 and the extension part 44, and has a strength partially reduced compared to a surrounding part of the boundary part. In this embodiment, the fragile part 45 is a part of the boundary part at which a groove part 45*a* is provided. The groove part 45*a* may be configured as a groove part extending in series in a circumferential direction of the burring part 43, or as a plurality of groove parts arranged intermittently in the circumferential direction. The fragile part 45 becomes a starting point of deformation of each extension part 44 when a force in an arrow Na direction is applied to each extension part 44 to set the plurality of extension parts 44 to an outwardly opened shape as shown in FIG. 8A. Accordingly, an impact (impact of the force in the Na direction) caused by deformation of each extension part 44 does not significantly affect the burring part 43. Thus, it is possible to prevent distortion in the burring part 43 and well maintain its dimensional accuracy.

Figure 7A:
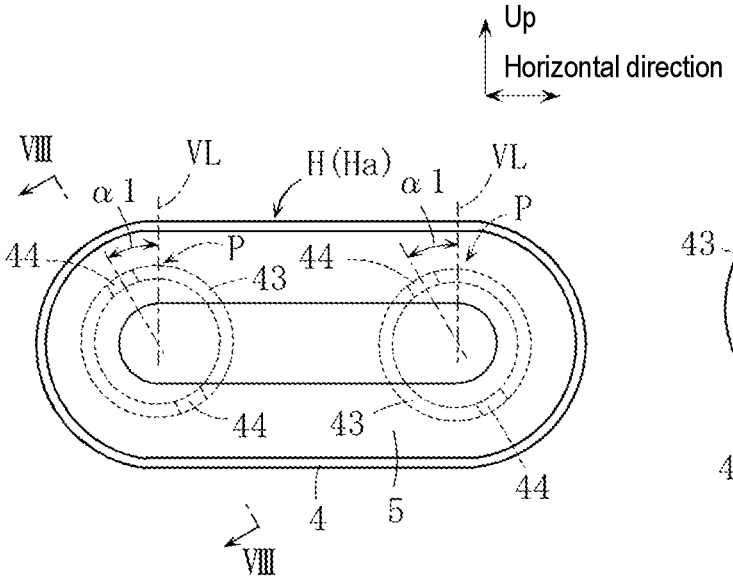
FIG. 7A is a schematic front view of a part of the header parts of the heat exchanger shown in FIG. 1 to FIG. 4.
Figure 7B:
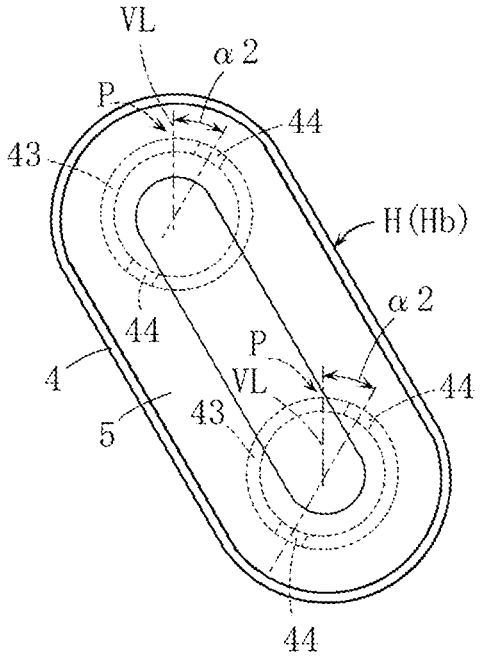
FIG. 7B is a schematic front view of another part of the header parts of the heat exchanger.

As shown in FIG. 7A and FIG. 7B, the extension parts 44 are provided at positions that avoid a topmost part P of the burring part 43 (in the figures, symbol VL indicates a vertical line passing through a center of the burring part 43).

The two extension parts 44 provided at the burring part 43 are separated in an up-down height direction, and one extension part 44 located on the upper side is offset from the topmost part P of the burring part 43 by appropriate angles $\alpha 1$ and $\alpha 2$.

Figure 9A:
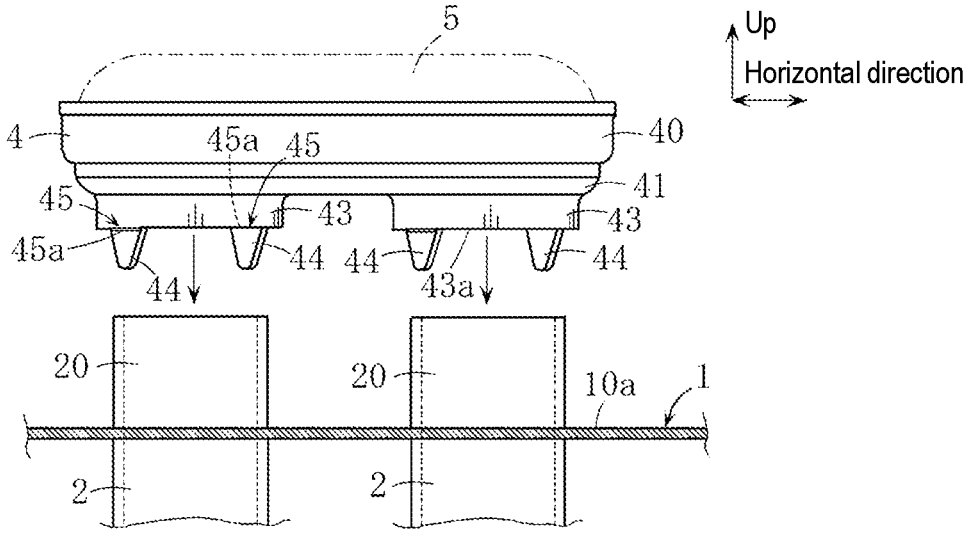
FIG. 9A and FIG. 9B are illustrative diagrams of a main part showing an example of an assembly operation process of the header part of the heat exchanger shown in FIG. 1 to FIG. 4.
Figure 9B:
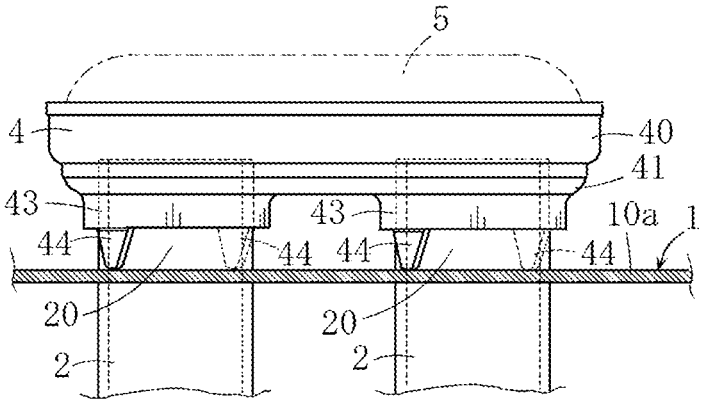

FIG. 9A and FIG. 9B show an example of an operation of attaching the header base 4 of the header part H to the end parts 20 of two heat transfer tubes 2. In the figures, in a posture in which the heat exchanger HE is set to lie sideways such that the end part 20 of each heat transfer tube 2 protrudes upward from the sidewall part 10*a*, the header base 4 is lowered from above the end part 20 of each heat transfer tube 2. Accordingly, the burring part 43 is externally fitted to the end part 20 of each heat transfer tube 2. Further, the header base 4 is lowered until the tip part of the extension part 44 abuts against the sidewall part 10*a*. Accordingly, it is possible to accurately define a distance from the sidewall part 10*a* to the burring part 43 of the header part H or to the main wall part 41 as a desired distance.

Figure 5:
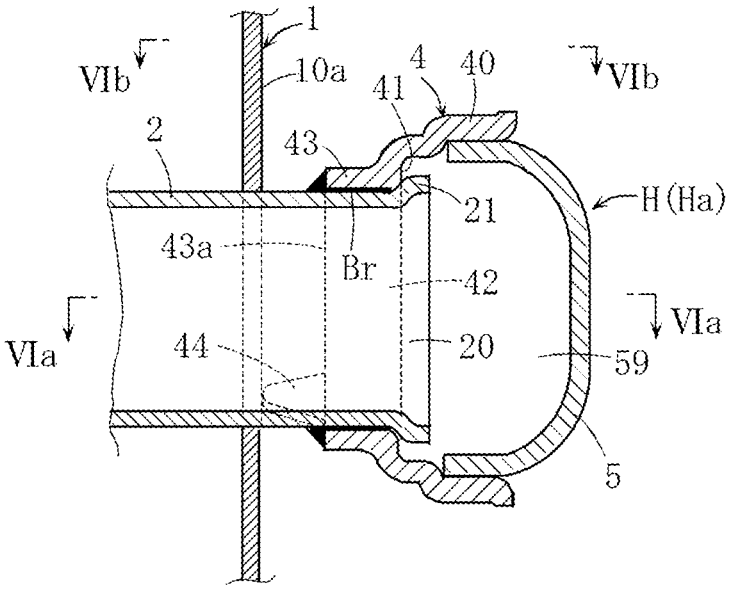
FIG. 5 is an enlarged cross-sectional view of part V in FIG. 4.
Figure 6A:
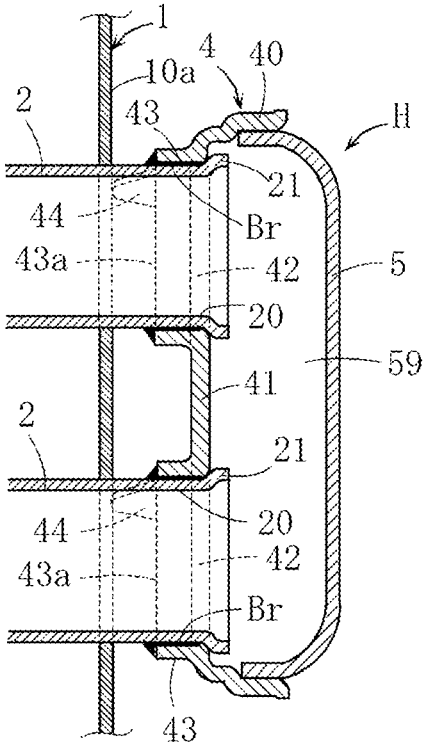
FIG. 6A is a cross-sectional view taken along line VIa-VIa in FIG. 5.
Figure 6B:
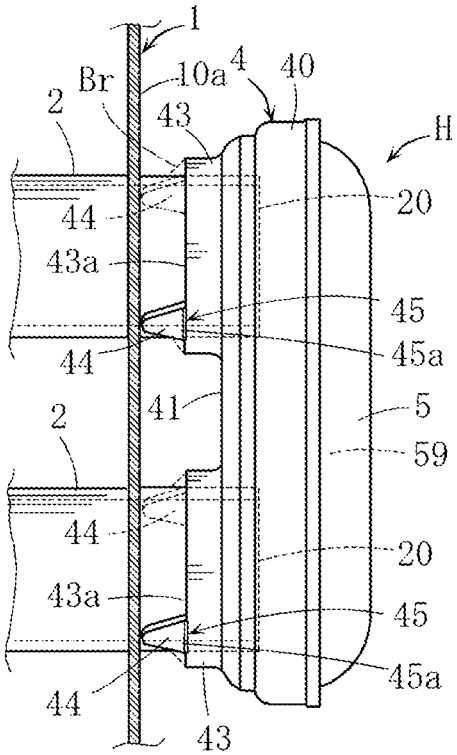
FIG. 6B is a cross-sectional view taken along line VIb-VIb in FIG. 5.

After finishing the assembly operation of externally fitting the burring part 43 to the end part 20 of the heat transfer tube 2 as shown in FIG. 9B, a tube expansion process is performed on the end part 20. After the tube expansion process is finished, a brazing part Br as described above is provided. In FIG. 5 and FIG. 6A, a flare part 21 is formed at an endmost tip part of the end part 20 of the heat transfer tube 2, and this flare part 21 is formed by the tube expansion process.

In a manufacturing process of the heat exchanger HE, in the case of performing the operation of providing the above-described brazing part Br of the header part H, as shown in FIG. 1 to FIG. 4, the heat exchanger HE is set in a posture in which the end part 20 of each heat transfer tube 2 extends in the horizontal direction and the case 1 stands upright in the up-down height direction. This posture corresponds to an example of a brazing-applicable posture capable of appropriately providing the brazing part Br. In the case where the heat exchanger HE is in such a brazing-applicable posture, the extension part 44 is arranged to avoid the topmost part P of the burring part 43.

Figure 10A:
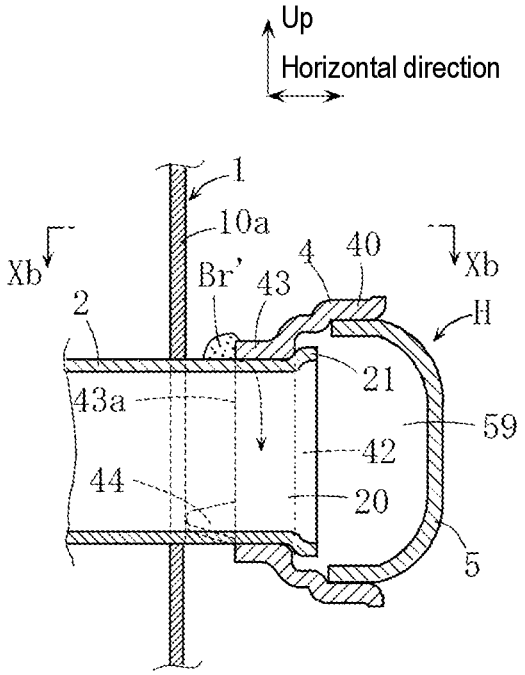
FIG. 10A is a cross-sectional view of a main part showing an example of a brazing operation process of the header part of the heat exchanger shown in FIG. 1 to FIG. 4.
Figure 10B:
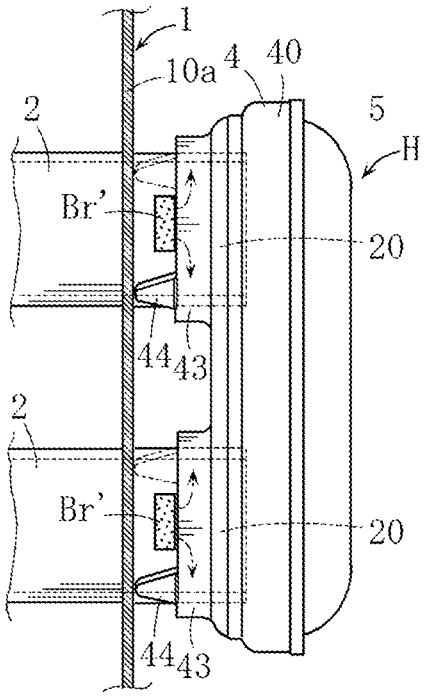
FIG. 10B is a cross-sectional view of a main part taken along line Xb-Xb in FIG. 10A.

As shown in FIG. 10A and FIG. 10B, the brazing operation for providing the brazing part Br is performed by applying, for example, a brazing material Br' in a paste shape to a topmost part of the outer circumferential surface of the end part 20 of the heat transfer tube 2 and heating and melting the brazing material Br'. With respect to this, in this embodiment, since the extension part 44 is located at a position avoiding the topmost part P of the burring part 43, it is possible to prevent interference with the above-described application of the brazing material Br'. In the state shown in FIG. 10A and FIG. 10B, upon heating and melting the brazing material Br', the melted brazing material flows downward along the outer circumferential surface of the end part 20 of the heat transfer tube 2, and during this process, it is possible to cause the melted brazing material to enter into a minute gap between the outer circumferential surface of the end part 20 and the inner circumferential surface of the burring part 43. The entry of the melted brazing material into this gap may be performed over the entire circumference of the end part 20 of the heat transfer tube 2.

Next, an action of the heat exchanger HE and a hot water apparatus WH will be described.

Although the tip part of the extension part 44 of each header part H abuts against the sidewall part 10*a* of the case 1, the abutment area is small. Different from this embodiment, for example, in the case where the abutment area between the header part H and the sidewall part 10*a* of the case 1 is large, when the temperature of the sidewall part 10*a* rises to a considerably high temperature due to supply of combustion gas into the case 1, the header part H is significantly affected and a large thermal stress occurs at the header part H, which is likely to strongly act on the sidewall part 10*a* and the end part 20 of the heat transfer tube 2 penetrating the sidewall part 10*a*. In contrast, according to this embodiment, it is possible to appropriately prevent or suppress such a situation and make it less likely for an undue thermal stress to be applied from the header part H to the end part 20 of the heat transfer tube 2.

On the other hand, the positioning of the header part H with respect to the sidewall part 10*a* of the case 1 is achieved by causing the tip part of the extension part 44 provided at each burring part 43 to abut against the sidewall part 10*a* of the case 1, as described with reference to FIG. 9A and FIG. 9B. Thus, the positioning operation of the header part H is easy, and it is also possible to arrange the header part H at a desired position with high accuracy. It is also not required to separately use a dedicated member (spacer) for determining the relative position between the sidewall part 10*a* of the case 1 and the header part H. Thus, it is possible to facilitate the manufacturing work of the heat exchanger HE, improve productivity of the heat exchanger, and suitably reduce the manufacturing cost.

In this embodiment, in addition to externally fitting the cylindrical burring part 43 of the header part H to the end part 20 of the heat transfer tube 2, since brazing is performed via the brazing part Br after the tube expansion process is performed on the end part 20, it is possible to increase the attachment strength of the header part H to the heat transfer tube 2. As described with reference to FIG. 7A, FIG. 7B, FIG. 10A, and FIG. 10B, since the extension part 44 of the header part H avoids the spot (topmost part P) at which the brazing material Br' is applied during the brazing operation, it is possible to perform the brazing operation more appropriately.

As described with reference to FIG. 8A and FIG. 8B, the inner width La between the tip parts of the two extension parts 44 of the header part H is larger than the inner diameter Da of the burring part 43, and the inner width La has a tip-spread slope shape that gradually increases toward the tip part side of the extension part 44. Thus, as shown in FIG. 9A and FIG. 9B, when performing an operation of assembling the header base 4 to the end part 20 of the heat transfer tube 2, it becomes easy to externally fit the two extension parts 44 to the end parts 20 of the heat transfer tubes 2, and thus it also becomes easy to externally fit the burring part 43 to the end part 20 following the extension part 44.

The disclosure is not limited to the contents of the embodiment described above. The specific configuration of each part of the heat exchanger and the hot water apparatus according to the disclosure may be subjected to various design changes within the scope intended by the disclosure.

In the above-described embodiment, two extension parts 44 are provided at one burring part 43, but the disclosure is not limited thereto, and the specific number of the extension parts 44 is not particularly limited. In the case of providing a plurality of extension parts 44, it is preferable that all of the plurality of extension parts 44 are not arranged side by side in a straight line at one header part H. Further, although the extension part 44 has a substantially triangular shape in a side view with a width that narrows toward the tip part side, it may also have a different shape (e.g., a substantially rectangular shape in a side view). The specific protruding dimension of the extension part 44 is also not particularly limited.

In the above-described embodiment, the groove part 45*a* is provided as a means for providing the fragile part 45 at the boundary part between the burring part 43 and the extension part 44, but the disclosure is not limited thereto. The fragile part in the disclosure may also be formed by, for example, providing the boundary part as a partial thin wall part or providing a slit extending in the circumferential direction of the burring part 43 instead of the groove part.

The header part may be configured not only to connect the end parts of two heat transfer tubes, but also to connect the end parts of three or more heat transfer tubes. Further, it may also be configured as a header part for water feeding or hot water discharge including a water inlet or a hot water outlet. In the case where a plurality of header parts are provided at the heat exchanger, not all of the plurality of header parts need to have the configuration intended by the disclosure, and as long as a part of the header parts have the configuration intended by the disclosure, they fall within the technical scope of the disclosure.

The heat transfer tube is not limited to a straight tube shape and may also have a meandering shape or a spiral shape. As described above, the body pipe 39 of the above-described embodiment may be included in the heat transfer tube in the disclosure. The hot water apparatus according to the disclosure is not limited to a reverse combustion type in which combustion gas is caused to progress from the upper side to the lower side of the heat exchanger, and may also be, for example, of a forward combustion type in which the direction of progression of combustion gas is the opposite. Further, as a heating medium other than the combustion gas, it is also possible to use, for example, a high-temperature exhaust gas generated in a cogeneration system instead of the combustion gas. Thus, it is possible to adopt a means other than the burner in the disclosure. The heat exchanger according to the disclosure is not limited to a heat exchanger for a hot water supply apparatus.

What is claimed is:

1. A heat exchanger comprising:

a case into which a combustion gas is supplied;

a plurality of heat transfer tubes that are accommodated in the case and have end parts drawn out to outside of the case via a plurality of hole parts provided at a sidewall part of the case; and a header part that is arranged on an outer surface side of the sidewall part, wherein the header part has:

a plurality of hole parts through which the end parts of the plurality of heat transfer tubes are inserted;

a chamber communicated to insides of the plurality of heat transfer tubes;

a plurality of burring parts in a tubular shape that are provided to protrude from circumferential edge parts of the plurality of hole parts of the header part toward a sidewall part side of the case, and are externally fitted to the end parts of the respective heat transfer tubes; and a plurality of extension parts, disposed at a tip circumferential edge part of each of the burring parts, and each of the plurality of extension parts is provided to partially extend from a part of the tip circumferential edge part of each of the burring parts toward the sidewall part side of the case, and each of the plurality of extension parts has a tip part abutting against the sidewall part.

2. The heat exchanger according to claim 1, wherein each of the plurality of extension parts is configured to have a width of the tip part that is smaller than a width of a base part.

3. The heat exchanger according to claim 1, further comprising:

a brazing part at which a brazing material enters between the end part of each of the heat transfer tubes and the burring part from an outer portion of the burring part on a tip circumferential edge part side.

4. The heat exchanger according to claim 3, wherein in a predetermined brazing-applicable posture in which the end part of each of the heat transfer tubes extends in a horizontal direction and the case stands upright in an up-down height direction, each of the plurality of extension parts is located at a position avoiding a topmost part of the burring part.

5. The heat exchanger according to claim 3, wherein the plurality of extension parts are provided at each of the burring parts, and an inner width between tip parts of the plurality of extension parts is larger than an inner diameter of each of the burring parts.

6. The heat exchanger according to claim 5, wherein the plurality of extension parts have a tip-spread slope shape in which an inner width of the plurality of extension parts gradually increases toward tip part sides of the plurality of extension parts.

7. The heat exchanger according to claim 1, wherein in the header part, a boundary part between each of the burring parts and each of the plurality of extension parts is provided with a fragile part having a strength partially reduced compared to a surrounding part of the boundary part.

8. A hot water apparatus comprising:

the heat exchanger according to claim 1; and a burner that supplies the combustion gas into the case of the heat exchanger.

* * * * *